US008659224B1

(12) United States Patent
Moon

(10) Patent No.: US 8,659,224 B1
(45) Date of Patent: Feb. 25, 2014

(54) ORGANIC LIGHT EMITTING DISPLAY APPARATUS AND METHOD FOR MANUFACTURING THE SAME

(71) Applicant: Seung-Jun Moon, Yongin (KR)

(72) Inventor: Seung-Jun Moon, Yongin (KR)

(73) Assignee: Samsung Display Co., Ltd., Yongin, Gyunggi-Do (KR)

( * ) Notice: Subject to any disclaimer, the term of this patent is extended or adjusted under 35 U.S.C. 154(b) by 0 days.

(21) Appl. No.: 13/682,016

(22) Filed: Nov. 20, 2012

(30) Foreign Application Priority Data

Sep. 6, 2012 (KR) ..... 10-2012-0098960

(51) Int. Cl.
*H01J 1/62* (2006.01)

(52) U.S. Cl.
USPC ..... 313/512; 445/25; 313/504

(58) Field of Classification Search
USPC ..... 313/512, 504, 506; 445/25
See application file for complete search history.

(56) References Cited

U.S. PATENT DOCUMENTS

| | | | | |
|---|---|---|---|---|
| 6,998,648 | B2 * | 2/2006 | Silvernail | 257/99 |
| 8,330,360 | B2 * | 12/2012 | Frischknecht | 313/512 |
| 2010/0300746 | A1 | 12/2010 | Mackenzie et al. | |
| 2010/0301375 | A1 | 12/2010 | Chen et al. | |

FOREIGN PATENT DOCUMENTS

| | | | |
|---|---|---|---|
| JP | 2001-155855 | A | 6/2001 |
| KR | 10-2011-0133812 | A | 12/2011 |
| KR | 10-2012-0027410 | A | 3/2012 |
| KR | 10-2012-0031382 | A | 4/2012 |
| WO | WO 2012/039554 | A2 | 3/2012 |

* cited by examiner

*Primary Examiner* — Mary Ellen Bowman
(74) *Attorney, Agent, or Firm* — Lee & Morse, P.C.

(57) ABSTRACT

An organic light-emitting display apparatus includes a substrate, a display device on the substrate, an encapsulating layer that covers the display device, that is bound to the substrate, and that includes a hole extending in a direction away from the substrate, and a getter filled in the hole.

17 Claims, 8 Drawing Sheets

ORGANIC LIGHT EMITTING DISPLAY APPARATUS AND METHOD FOR MANUFACTURING THE SAME

CROSS-REFERENCE TO RELATED APPLICATION

This application claims priority under 35 U.S.C. §119 to Korean Patent Application No. 10-2012-0098960, filed on Sep. 6, 2012, in the Korean Intellectual Property Office, the disclosure of which is incorporated herein in its entirety by reference.

BACKGROUND

Organic light-emitting display apparatuses are self-emissive display apparatuses that may exclude a separate light source. The organic light-emitting display apparatuses may be driven at a low voltage, are thin and lightweight, and have high quality properties such as wide viewing angles, an excellent contrast ratio, and high response times, and thus, are regarded as next-generation displays.

SUMMARY

Embodiments may be realized by providing an organic light-emitting display apparatus that includes a substrate, a display device formed on the substrate, an encapsulating layer that covers the display device, which is bound to the substrate, and includes therein a hole extending in a direction away from the substrate, and a getter filled in the hole.

The encapsulating layer may include at least one structure in which a first encapsulating layer and a second encapsulating layer are alternately stacked. The first encapsulating layer may include a first hole extending in a direction away from the substrate. The second encapsulating layer may include a second hole extending in a direction away from the substrate. The first hole and the second hole may be arranged in a thickness direction of the encapsulating layer.

The first hole and the second hole may be formed at the substantially same location. The encapsulating layer may be formed larger than the display device to cover the display device, an edge of the encapsulating layer may be bound to the substrate, and the hole may be formed in the edge of the encapsulating layer.

The hole may be formed at one or more corners from among corners of the encapsulating layer. The hole may extend long along at least one side from among sides of the encapsulating layer.

Embodiments may also be realized by providing an organic light-emitting display apparatus that includes a substrate, a display area that is formed on the substrate and includes the display device, a non-display area formed around the display area on the substrate, an encapsulating layer that is formed on the display area and the non-display area and includes a hole extending in a direction away from the substrate, and a getter disposed in the hole.

The encapsulating layer may include at least one structure in which a first encapsulating layer and a second encapsulating layer are alternately stacked. Any one of the first encapsulating layer and the second encapsulating layer may include an inorganic material, and the other may include an organic material. The hole may be formed in the non-display area.

Embodiments may be realized by providing a method of manufacturing an organic light-emitting display apparatus, the method including forming a display area including a display device and formed on a substrate, forming an encapsulating layer that is disposed on the display area and a non-display area formed around the display area and may include a hole extending in a direction away from the substrate, and disposing a getter in the hole.

The forming of the encapsulating layer may include forming a first encapsulating layer including a first hole, out-gassing an impurity gas contained in the first encapsulating layer via the first hole, forming a second encapsulating layer including a second hole and formed on the first encapsulating layer, and out-gassing an impurity gas contained in the second encapsulating layer via the second hole.

The out-gassing of the impurity gas may be performed under an inert gas atmosphere. The first hole and the second hole may be arranged in a thickness direction of the encapsulating layer. The first hole and the second hole may be formed at the substantially same location.

The hole may be formed in the non-display area. The hole may be formed in a corner of the non-display area. The hole may be formed long along a side of the encapsulating layer.

BRIEF DESCRIPTION OF THE DRAWINGS

Features will become more apparent by describing in detail exemplary embodiments thereof with reference to the attached drawings in which.

DETAILED DESCRIPTION

Figure 1:
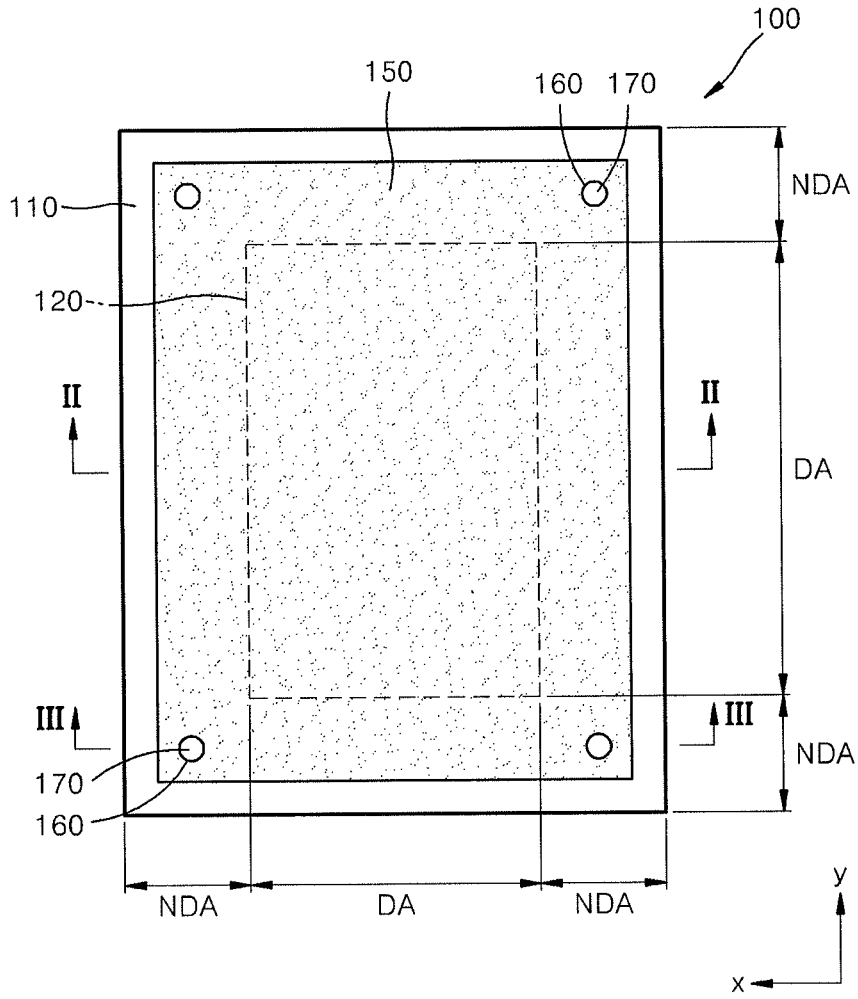
FIG. 1 is a top plan view of an organic light-emitting display apparatus, according to an exemplary embodiment.

Embodiments will now be described more fully with reference to the accompanying drawings, in which exemplary embodiments are shown. Reference will now be made in detail to example embodiments, examples of which are illustrated in the accompanying drawings. However, example embodiments are not limited to the embodiments illustrated hereinafter, and the embodiments herein are rather introduced to provide easy and complete understanding of the scope and spirit of example embodiments. The terminology used herein is for the purpose of describing particular embodiments only and is not intended to be limiting of example embodiments. As used herein, the singular forms "a," "an" and "the" are intended to include the plural forms as well, unless the context clearly indicates otherwise.

It will be further understood that the terms "comprises" and/or "comprising" used herein specify the presence of stated components, steps, and/or devices, but do not preclude the presence or addition of one or more other components, steps, and/or devices. It will be understood that, although the terms 'first', 'second', etc. may be used herein to describe various elements should not be limited by these terms. These terms are only used to distinguish one element from another element.

In the drawings, the thicknesses of layers and regions are exaggerated for clarity, and the same elements are denoted by the same reference numerals. It will be understood that when a portion such as a layer, a film, a region, or a board is referred to as being "on" another portion can be directly on another portion or intervening portions. Expressions such as "at least one of," when preceding a list of elements, modify the entire list of elements and do not modify the individual elements of the list.

Figure 2:
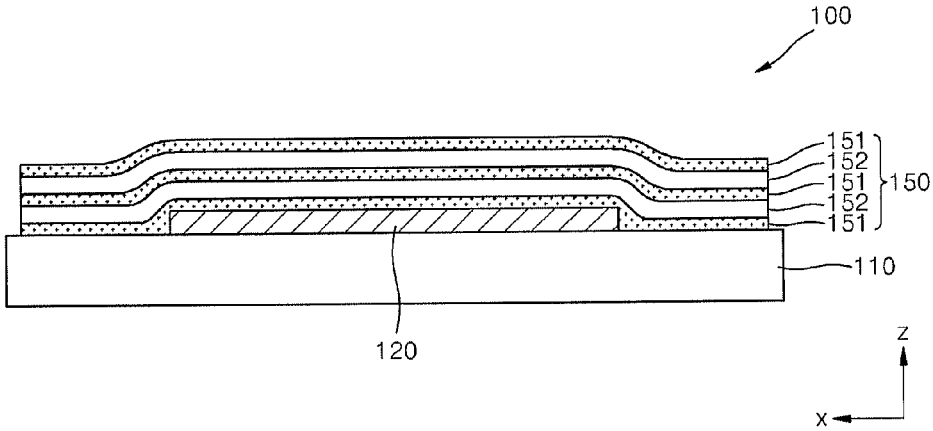
FIG. 2 is a cross-sectional view taken along line II-II of FIG. 1.
Figure 3:
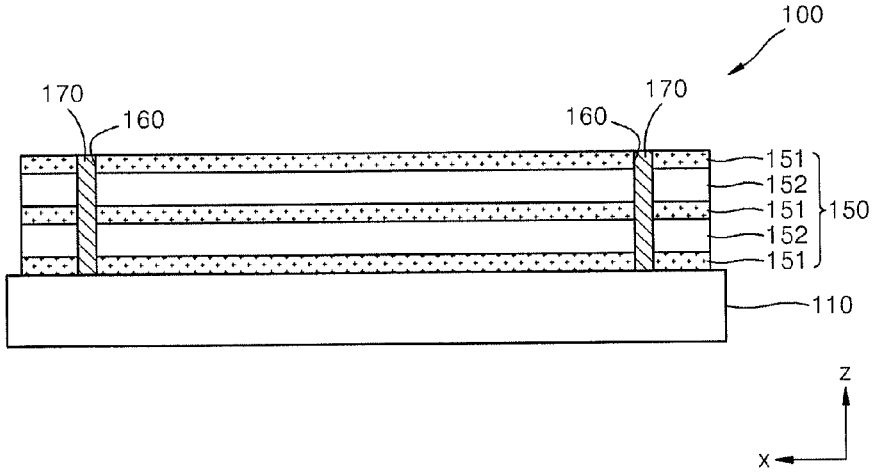
FIG. 3 is a cross-sectional view taken along line of FIG. 1.

FIG. 1 is a top plan view of an organic light-emitting display apparatus 100, according to an exemplary embodiment. FIG. 2 is a cross-sectional view taken along line II-II of FIG. 1. FIG. 3 is a cross-sectional view taken along line of FIG. 1.

Referring to FIGS. 1 to 3, the organic light-emitting display apparatus 100 includes a substrate 110, a display device 120 formed on the substrate 110, an encapsulating layer 150 covering the display device 120 and including the hole 160, and a getter 170 disposed in the hole 160.

The substrate 110 may be a flexible plastic substrate. For example, the substrate 110 may include one selected from the group of polyethersulfone (PES), polyacrylate (PAR), polyetherimide (PEI), polyethylene naphthalate (PEN), polyethylene terephthalate (PET), polyphenylene sulfide (PPS), polyallylate, polyimide (PI), polycarbonate (PC), poly (arylene ether sulfone), and combinations thereof. However, embodiments are not limited thereto, e.g., the substrate 110 may be formed of various materials such as metal or glass.

The substrate 110 may be a rectangular substrate including long side portions parallel to one another in a first direction and short side portions perpendicular to the long side portions, A display area DA in which the display device 120 is formed and a non-display area NDA formed around the display area DA are formed on the substrate 110. The display area DA may be formed in a central area of the substrate 110, and the non-display area NDA may be formed in a peripheral area of the substrate 110 to surround lateral sides of the display area DA.

The display device 120 is formed on the substrate 110, and forms the display area DA of the organic light-emitting display apparatus 100. The display device 120 disposed in the display area DA may emit red, green, and blue light according to flow of current to display predetermined image information. A detailed configuration of the display device 120 will be described below with reference to FIG. 4.

The encapsulating layer 150 covers the display device 120 and includes the hole 160 extending in a direction away from the display device 120. The hole 160 may be formed in the non-display area NDA. For example, the hole 160 may be formed along an edge of the encapsulating layer 150, and may be formed in four corners as shown in FIG. 1.

The encapsulating layer 150 may protect the display device 120 by sealing the display device 120 from the outside. The encapsulating layer 150 may be configured as a thin film including at least one first encapsulating layer 151 and at least one second encapsulating layer 152. The organic light-emitting display apparatus 100 may be made flexible and thin by the encapsulating layer 150 formed as a thin film and the substrate 110 formed as a flexible substrate.

The first encapsulating layer 151 and the second encapsulating layer 152 may be alternately stacked and may be formed of different materials. For example, the first encapsulating layer 151 may be an inorganic layer, and the second encapsulating layer 152 may be an organic layer. Alternatively, the first encapsulating layer 151 may be an organic layer, and the second encapsulating layer 152 may be an inorganic layer. In the current embodiment, for convenience of description, a case where the first encapsulating layer 151 is an organic layer and the second encapsulating layer 152 is an inorganic layer will be described.

The inorganic layer may be formed of one from among metal oxide, metal nitride, metal carbide, and a compound thereof. For example, the inorganic layer may include an inorganic material such as $AlO_x$, $TiO_2$, ZrO, $SiO_x$, AlON, AlN, $SiN_X$, $SiO_xN_y$, $InO_x$, or $YbO_x$.

The organic layer may include a polymer-based material. Examples of the polymer-based material may include an acryl-based resin, an epoxy-based resin, a polyimide, polyethylene, and the like. The organic layer may reduce internal stress of the inorganic layer, may supplement defects of the inorganic layer, and may planarize the inorganic layer.

In the current embodiment, the first encapsulating layer 151 is stacked three times and the second encapsulating layer 152 is stacked twice. However, embodiments are not limited thereto, i.e., a number of times in which the first encapsulating layer 151 and the second encapsulating layer 152 are alternately stacked is not limited.

An area of the encapsulating layer 150 is formed greater than that of the display device 120, and thus the encapsulating layer 150 may cover the entire display device 120. In other words, the encapsulating layer 150 may be formed to cover not only the display area DA but also non-display area NDA, and thus an edge of the encapsulating layer 150 may be bound to the substrate 110.

The hole 160 is formed in the edge of the encapsulating layer 150, that is, an area corresponding to the non-display area NDA of the encapsulating layer 150. The hole 160 extends long in a thickness direction (Z-direction) of the encapsulating layer 150, which is a direction away from the substrate 110. The hole 160 may perform an out-gassing of impurity gases included in the first and second encapsulating layers 151 and 152 during formation of the encapsulating layer 150. For example, during the formation of a stacked structure of the first encapsulating layer 151 and the second encapsulating layer 152, the hole 160 may perform the out-gassing of the impurity gases. The out-gassing of the impurity gas through the hole 160 will be described below with reference to FIGS. 5A to 5H.

The getter 170 may be formed in the hole 160. For example, when the hole 160 includes a plurality of holes 160, one of a plurality of getters 170 may be formed in each of the plurality of holes 160. The getter 170 filling in, e.g., completely filling in, the hole 160 may have hygroscopicity. For example, the getter 170 may be a material that easily absorbs moisture. Accordingly, the getter 170 may reduce the possibility of and/or prevent moisture from entering the display device 120 from the outside. Since the hole 160 of the encapsulating layer 150 may be sealed/closed by the getter 170, the display device 120 may be isolated from the outside, and a life-span of the display device 120 may be maintained for a long time. The getter 170 may be in a hardened state changed from its liquid state.

Figure 4:
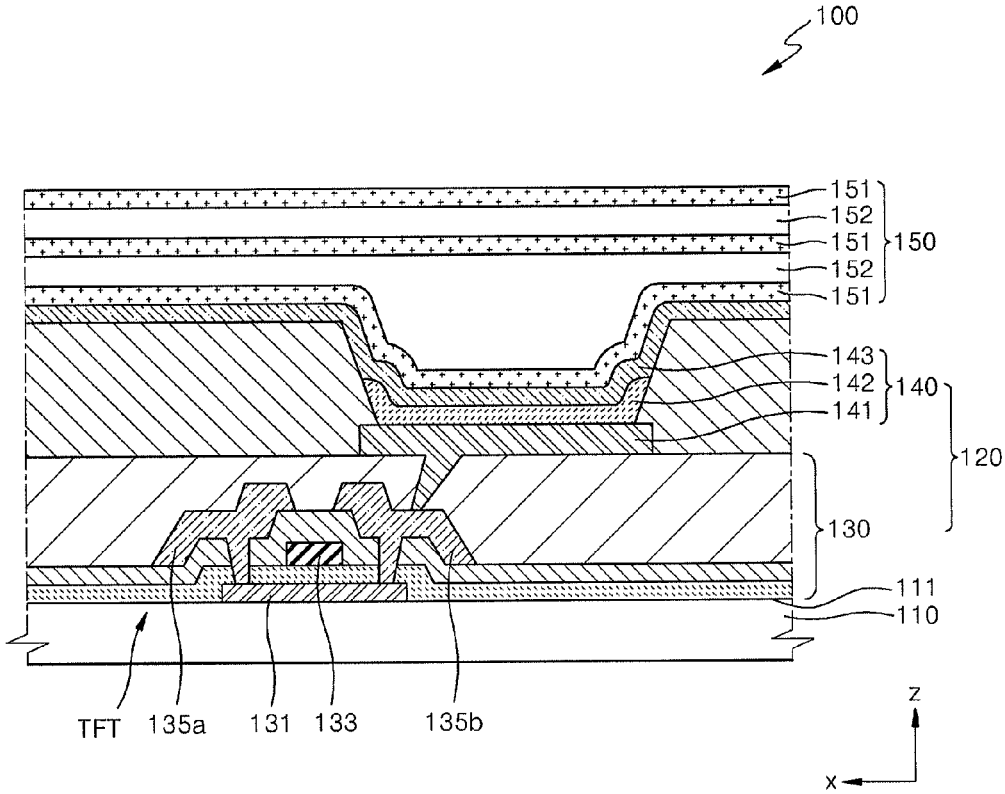
FIG. 4 is a schematic cross-sectional view of an exemplary pixel area of the organic light-emitting display apparatus of FIG. 1.

FIG. 4 is a schematic cross-sectional view of a pixel area of the organic light-emitting display apparatus 100 of FIG. 1.

Referring to FIG. 4, the display device 120 may include an organic light-emitting device 140 that includes a pixel electrode 141 disposed on the substrate 110, a counter electrode 143 disposed on the pixel electrode 141, and an organic emission layer 142 interposed between the pixel electrode 141 and the counter electrode 143. The organic light-emitting device 140 may emit red, green, and/or blue light according to flow of current to display predetermined image information, and may be disposed on the device/wiring layer 130.

The device/wiring layer 130 is disposed on a first surface of the substrate 110. The device/wiring layer 130 includes a driving thin film transistor (TFT) capable of driving the organic light-emitting device 140, a switching TFT (not shown), a capacitor, and wiring lines (not shown) connected to the driving TFT, the switching TFT, or the capacitor. The driving TFT includes an active layer 131, a gate electrode 133, a source electrode 135*a*, and a drain electrode 135*b*. The device/wiring layer 130 may include at least one insulating layers such as a gate insulating layer 111.

Although not shown in FIG. 4, a barrier layer may further be disposed between the substrate 110 and the device/wiring layer 130 to reduce the possibility of and/or prevent external substances such as moisture or oxygen from passing through the substrate 110 and penetrating the organic light-emitting device 140.

The organic light-emitting device 140 is disposed on the device/wiring layer 130. The organic light-emitting device 140 includes a pixel electrode 141, an organic emission layer 142 disposed on the pixel electrode 141, and a counter electrode 143 formed on the organic emission layer 142.

In the current embodiment, the pixel electrode 141 may be an anode, and the counter electrode 143 may be a cathode. However, embodiments are not limited thereto, e.g., the pixel electrode 141 may be a cathode and the counter electrode 143 may be an anode according to a method of driving the pixel area of the organic light-emitting display apparatus 100. Holes and electrons respectively from the pixel electrode 141 and the counter electrode 143 are injected into the organic emission layer 142. When excitons in which the injected holes are electrons are bound to each other drop from an excitation state to a ground state, light is emitted.

The pixel electrode 141 is electrically connected to the driving TFT formed in the device/wiring layer 130.

In the current embodiment, the organic light-emitting device 140 is disposed on the device/wiring layer 130 in which the driving TFT is formed. However, embodiments are not limited thereto, e.g., the organic light-emitting device 140 may be changed in various ways. For example, the pixel electrode 141 of the organic light-emitting device 140 may be formed in the same layer as the active layer 131 of the driving TFT, the pixel electrode 141 may be formed in the same layer as the gate electrode 133 of the driving TFT, or the pixel electrode 141 may be formed in the same layer as the source and drain electrodes 135*a* and 135*b*.

Also, in the driving TFT of the current embodiment, the gate electrode 133 is disposed on the active layer 131. However, embodiments are not limited thereto, e.g., the gate electrode 133 may be disposed below the active layer 131.

The pixel electrode 141 may be a reflective layer, and the counter electrode 143 disposed to opposite to the pixel electrode 141 may be formed of a transparent layer or a semitransparent layer to allow light emitted from the organic emission layer 142 to penetrate the counter electrode 143.

In the current embodiment, light emitted from the organic light-emitting device 140 may be emitted toward a front surface, e.g., in a direction that faces away from a front surface of the substrate 110 (top emission type). However, embodiments are not limited thereto, e.g., an embodiment where light is emitted toward a bottom surface of the substrate 110 (bottom emission type) or an embodiment where light is emitted toward and away from both the front and bottom surfaces of the substrate 110 (both-sides emission type) are possible.

When the organic light-emitting display apparatus is a bottom emission type organic light-emitting display apparatus, the pixel electrode 141 may be formed of a semitransparent layer, and the counter electrode 143 may be formed of a reflective layer. Also, when the organic light-emitting display apparatus is a both-sides emission type organic light-emitting display apparatus, the pixel electrode 141 and the counter electrode 143 may be formed of a transparent or semitransparent layer.

The encapsulating layer 150 has a structure in which the first encapsulating layer 151 and the second encapsulating layer 152 are alternately stacked, and a detailed description thereof has been described above.

According to the current embodiment, a process of forming the hole 160 in the encapsulating layer 150 and a process of out-gassing of an impurity gas included in the encapsulating layer 150 via the hole 160 may be performed. By discharging the impurity gas through the out-gassing, progressive dark spots that may be generated due to the impurity gas may be removed, and thus a life-span of the organic light-emitting display apparatus 100 may be increased. Also, the impurity gas may reduce the possibility of and/or prevent another layer disposed below (or above) the encapsulating layer 150 from being damaged.

Hereinafter, a process of manufacturing the organic light-emitting display apparatus 100, in particular, a process of forming the encapsulating layer 150, will be mainly described with reference to FIGS. 5A to 5H.

FIGS. 5A to 5H are cross-sectional views taken along line of FIG. 1, and for describing a process of manufacturing the organic light-emitting display apparatus 100 of FIG. 1. Thus, the display device 120 formed on the substrate 110 is not shown in FIGS. 5A to 5H. A method of manufacturing the organic light-emitting display apparatus 100 is as follows.

First, the display device 120 is formed on the substrate 110. As described above with reference to FIGS. 1, 2, and 4, forming the display device 120 includes forming the organic light-emitting device 140 and the device/wiring layer 130 on the substrate 110. The organic light-emitting device 140 may include the pixel electrode 141, the organic emission layer 142, and the counter electrode 143.

The substrate 110, which may be a flexible substrate, may be a plastic substrate including polymer with an excellent heat-resisting property and durability as described above. The substrate 110 may be disposed on a supporting substrate (not shown) formed of, e.g., glass for supporting the substrate 110 that is flexible. The supporting substrate (not shown) may be removed after the process is finished or during the process. Alternatively, the substrate 110 may be formed of a metal or glass material, as described above.

The device/wiring layer 130 may include a driving TFT (see FIG. 4) for driving the organic light-emitting device 140, a capacitor (not shown), and a wiring lines (not shown). The pixel electrode 141, the organic emission layer 142, and the counter electrode 143 are sequentially formed on the device/wiring layer 130.

The pixel electrode 141 may be a reflective electrode, and the counter electrode 143 may be a transparent or semitransparent electrode. Thus, light emitted from the organic emission layer 142 may be directly emitted toward the counter electrode 143 or may be reflected by the pixel electrode 141 and then emitted. In this regard, a resonance structure including the pixel electrode 141 and the counter electrode 143 may be formed by forming the counter electrode 143 as a semitransparent electrode.

The organic light-emitting display apparatus 100 may be formed as a top-emission type organic light-emitting display apparatus, as described above. Alternatively, the organic light-emitting display apparatus 100 may be formed as a bottom-emission type or both-sides emission type organic light-emitting display apparatus. At this time, the pixel electrode 141 and the counter electrode 143 may have the same characteristics as those described above.

The organic emission layer 142 may be formed of a low or high molecular organic material. In addition to the organic emission layer 142, an intermediate layer, as described above, may be selectively formed between the pixel electrode 141 and the counter electrode 143. In the current embodiment, a case where the organic light-emitting device 140 is formed on the device/wiring layer 130 has been described. However, embodiments are not limited thereto, e.g., the device/wiring layer 130 and the organic light-emitting device 140 may be formed in the same layer.

Figure 5A:
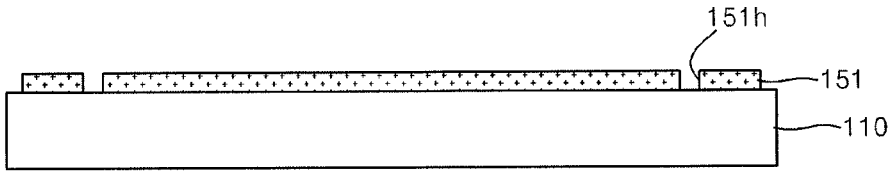
FIGS. 5A to 5H are cross-sectional views taken along line III-III of FIG. 1, and depicting stages of an exemplary process of manufacturing the organic light-emitting display apparatus of FIG. 1.

Next, as shown in FIG. 5A, the first encapsulating layer 151 is formed. At this time, the first encapsulating layer 151 is formed to include a first hole 151*h*. The first hole 151*h* may be a plurality of holes 151*h* that are formed at, e.g., four corners of the first encapsulating layer 151. The first encapsulating layer 151 may be an organic layer. The organic layer may include a polymer-based material, e.g., an acryl-based resin, an epoxy-based resin, a polyimide, polyethylene, and the like. However, embodiments are not limited thereto, e.g., the first encapsulating layer 151 may be an inorganic layer. The first encapsulating layer 151 may be formed by coating a liquid thereon, except for a region corresponding to the first hole 151*h*, by using a mask (not shown). According to another embodiment, the first encapsulating layer 151 may be formed by using various methods, for example, sputtering, chemical vapor deposition (CVD), plasma enhanced CVD (PECVD), ion beam assisted deposition (IBAD), or atomic layer deposition (ALD).

Figure 5B:
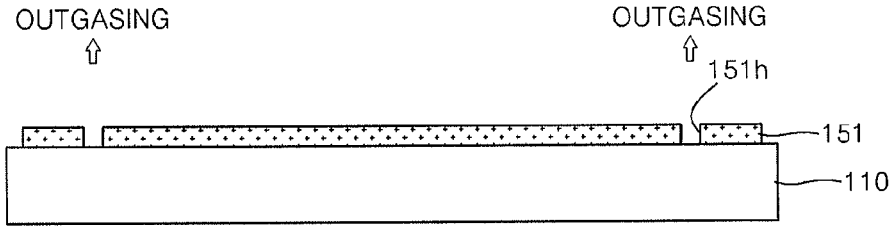

Referring to FIG. 5B, out-gassing of the impurity gas included in the first encapsulating layer 151 is performed via the first hole 151*h*. The impurity gas included in the first encapsulating layer 151, e.g., gas remaining inside the first encapsulating layer 151 without participating in configuration of the first encapsulating layer 151 may be evacuated via the first hole 151*h*. The out-gassing of the impurity gas may be formed under an inert gas atmosphere, e.g., in a reaction chamber. In other words, before the evacuation of the impurity gas is performed via the first hole 151*h*, an inert gas such as nitrogen ($N_2$) or argon (Ar) may be used as a purge gas. For example, the purge gas may assist in the out-gassing of the impurity gas through the first hole 151*h*.

Figure 5C:
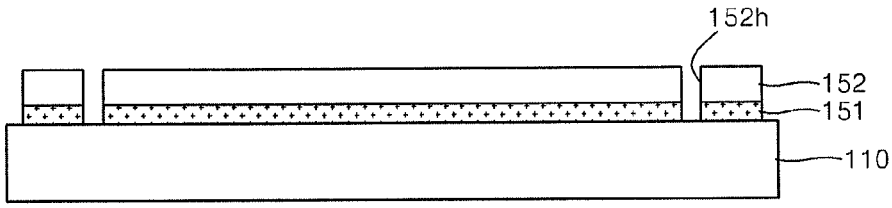

Referring to FIG. 5C, the second encapsulating layer 152 is formed. The second encapsulating layer 152 may be formed to include a second hole 152*h*. In this regard, the first hole 151*h* and the second hole 152*h* are formed at the substantially same location so that the first hole 151*h* and the second hole 152*h* are arranged in a thickness direction (z-axis direction). The second encapsulating layer 152 may be an inorganic layer. The inorganic layer may include an inorganic material, such as $AlO_x$, $TiO_2$, ZrO, $SiO_x$, AlON, AlN, $SiN_x$, $SiO_xN_y$, $InO_x$, and/or $YbO_x$, but embodiments are not limited thereto. The second encapsulating layer 152 may be formed by using any one method from among the methods for forming the first encapsulating layer 151.

Figure 5D:
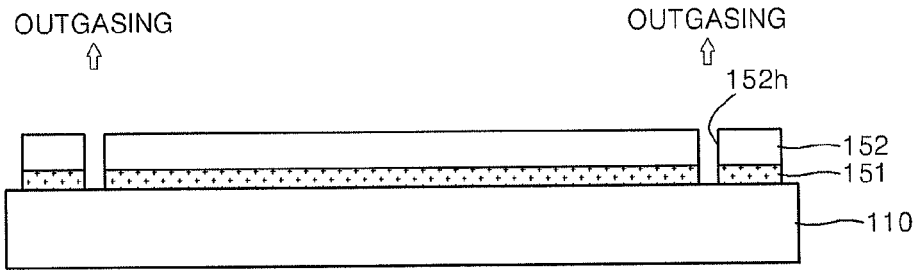

Referring to FIG. 5D, out-gassing of an impurity gas included in the second encapsulating layer 152 is performed via the second hole 152*h*. The impurity gas included in the second encapsulating layer 152, e.g., gas remaining inside the second encapsulating layer 152 without participating in configuration of the second encapsulating layer 152 may be evacuated via the second hole 152*h*. The out-gassing of the impurity gas may be formed under an inert gas atmosphere. As described above, before the impurity gas is evacuated, an inert gas such as $N_2$ or Ar may be supplied as a purge gas into a chamber (not shown) in which the second encapsulating layer 152 is formed.

Figure 5E:
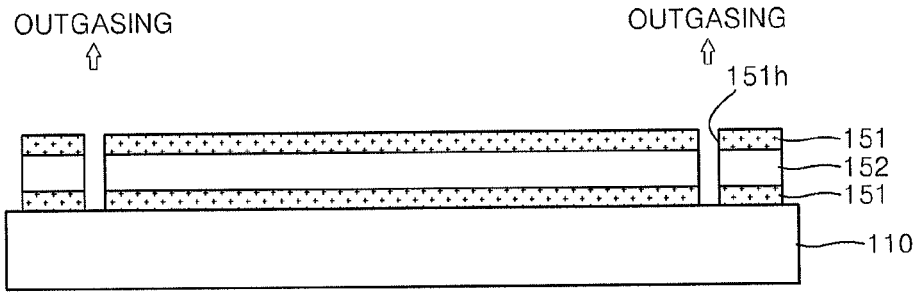

Referring to FIG. 5E, the first encapsulating layer 151 including the first hole 151*h* is formed on the second encapsulating layer 152, and then out-gassing of the first encapsulating layer 151 is performed. A method of forming the first encapsulating layer 151 and a method of performing out-gassing have been given already with reference to FIGS. 5A and 5B.

Figure 5F:
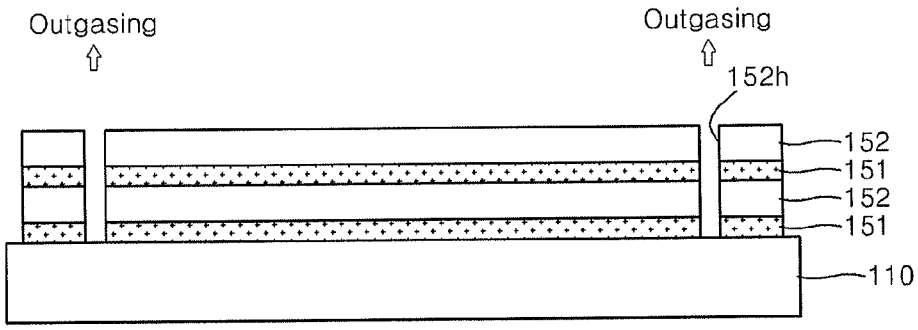

Referring to FIG. 5F, the second encapsulating layer 152 including the second hole 152*h* is formed on the first encapsulating layer 151, and then out-gassing of the second encapsulating layer 152 is performed. A method of forming the second encapsulating layer 152 and a method of performing out-gassing have been given already with reference to FIGS. 5C to 5E.

Figure 5G:
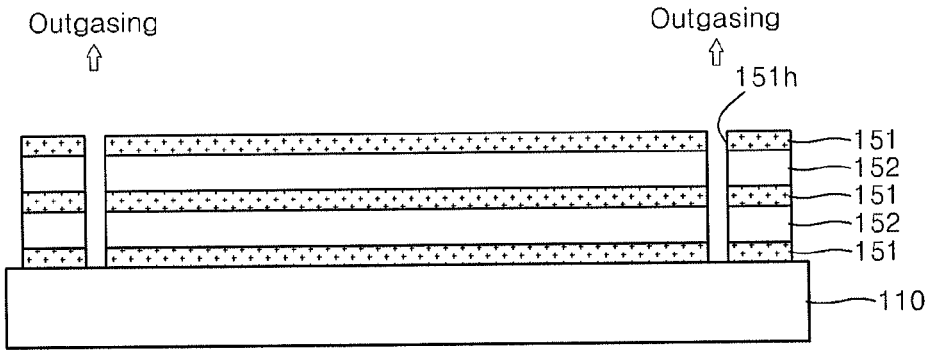

Referring to FIG. 5G, the first encapsulating layer 151 including the first hole 151*h* is formed on the second encapsulating layer 152, and then out-gassing of the first encapsulating layer 151 is performed. A method of forming the first encapsulating layer 151 and a method of performing out-gassing have been given already with reference to FIGS. 5A and 5B.

Figure 5H:
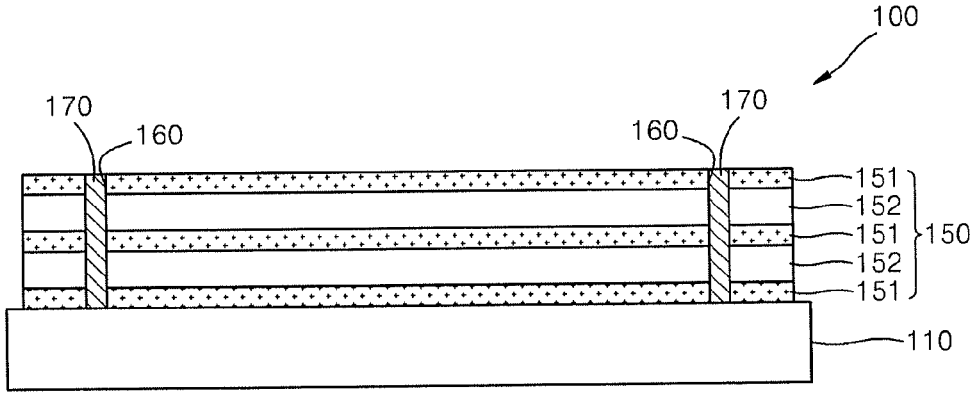

Referring to FIG. 5H, the getter 170 is disposed inside the hole 160. As described above, the first hole 151*h* of the first encapsulating layer 151 and the second hole 152*h* of the second encapsulating layer 152 are formed at the substantially same location, e.g., so as to completely overlap each other, and thus the hole 160 penetrating the encapsulating layer 150 is formed in the encapsulating layer 150. The hole 160 may extend in a thickness direction of the encapsulating layer 150, and accordingly a top surface of the substrate 110 may be exposed through the hole 160. If the hole 160 is left as it is, a path through which external moisture or oxygen may penetrate may be generated in a direction perpendicular to the thickness of the encapsulating layer 150, that is, along an interface between the first encapsulating layer 151 and the second encapsulating layer 152, and thus moisture or oxygen may penetrate the display device 120 through the path. Therefore, the getter 170 in a paste state may be injected into the hole 160 to block the path.

After the getter 170, e.g., in a paste state is injected into the hole 160, the getter 170 in a liquid/paste state is hardened to form the getter 170 in a solid state. Since the getter 170 has hygroscopicity, the getter 170 may block external moisture. Also, since the hole 160 is filled with the getter 170, a path through which moisture/oxygen may penetrate along the interface between the first encapsulating layer 151 and the second encapsulating layer 152 may be blocked.

Figure 6:
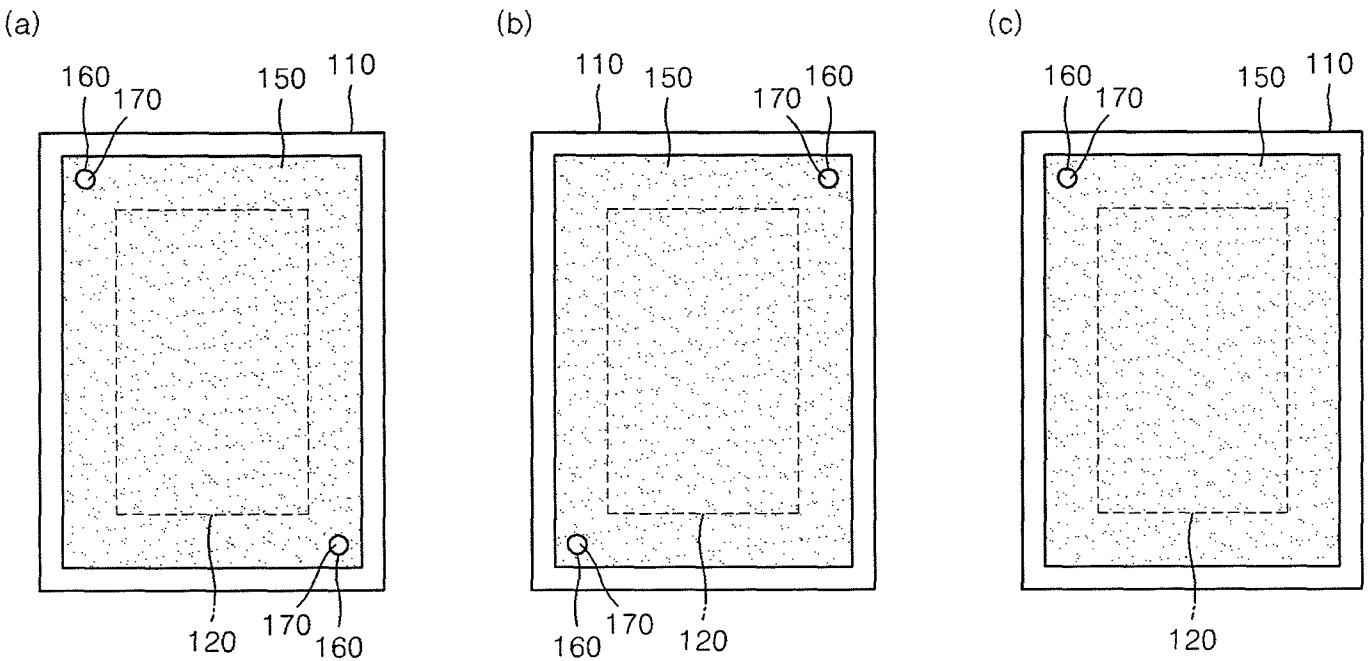
FIG. 6 illustrates schematic top plan views of an organic light-emitting display apparatus, according to an exemplary embodiment.

FIG. 6 includes FIGS. 6(*a*) to 6(*c*), which are schematic top plan views of an organic light-emitting display apparatus, according to another exemplary embodiment.

Referring to FIGS. 6(*a*) and 6(*b*), the hole 160 is disposed at an edge of the encapsulating layer 150, that is, in a non-display area of the organic light-emitting display apparatus. The hole 160 may be disposed at two corners from among four corners. Alternatively, as shown in FIG. 6(*c*), the hole 160 may be disposed at only one corner from among the four corners. In the exemplary embodiments, a cross-section of the hole 160 has a circular shape. However, this is just an example, and it is obvious that the hole 160 may have any of various shapes.

Figure 7:
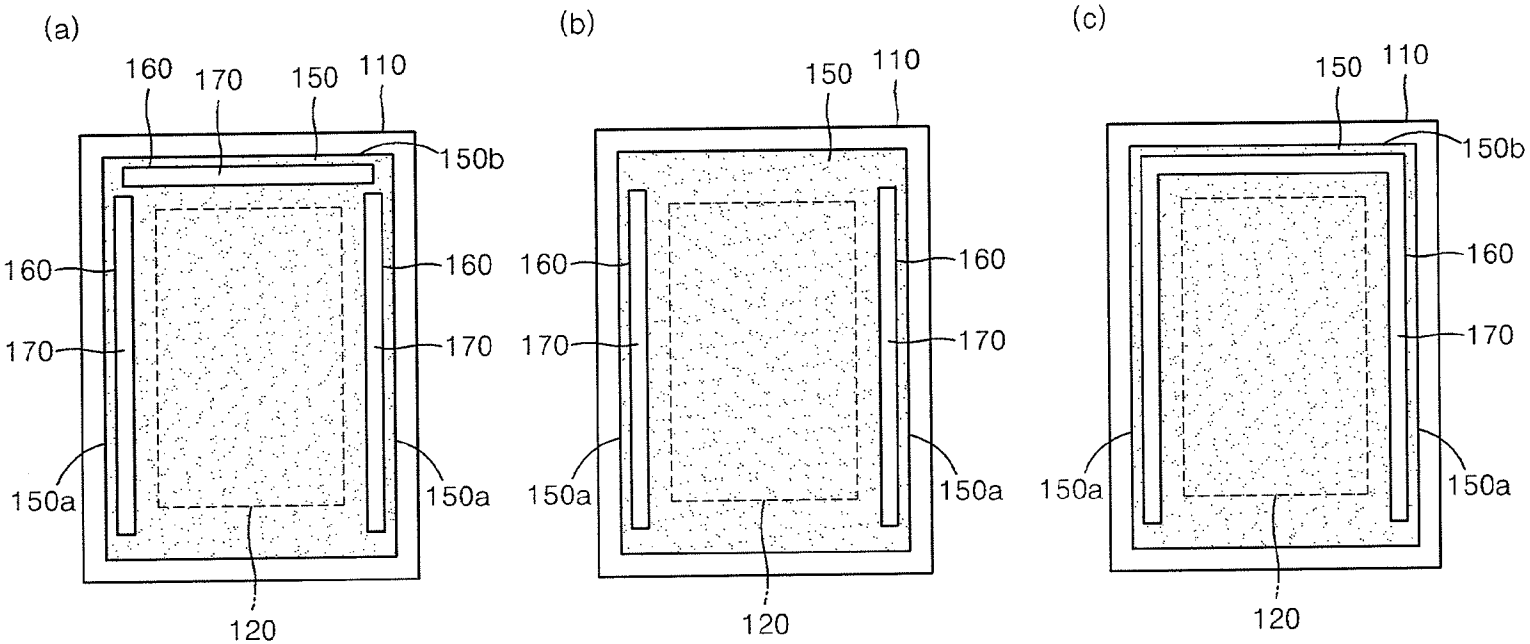
FIG. 7 illustrates schematic top plan views of an organic light-emitting display apparatus, according to an exemplary embodiment.

FIG. 7 includes FIGS. 7(*a*) to 7(*c*), which are schematic top plan views of an organic light-emitting display apparatus, according to another exemplary embodiment. Referring to FIGS. 7(*a*) and 7(*b*), the hole 160 may extend long along at least one side from among sides of the encapsulating layer 150. As shown in FIG. 7(*a*), the hole 160 may be formed along first and second long sides 150*a* and a first short side 150*b* of the encapsulating layer 150. Alternatively, as shown in FIG. 7(*b*), the hole 160 may be formed along the first and second long sides 150*a* of the encapsulating layer 150. Alternatively, referring to FIG. 7(*c*), the hole 160 may be successively formed along the first and second long sides 150*a* and the first short side 150*b* of the encapsulating layer 150.

As described above, the hole 160 having various shapes may be selected in consideration of a size of the organic light-emitting display apparatus, a thickness of the encapsulating layer 150, and the like.

By way of summation and review, an organic light-emitting display apparatus includes an organic light-emitting device that may have a hole injection electrode, an electron injection electrode, and an organic emission layer formed therebetween. The organic light-emitting display apparatus is a self-emissive display apparatus that generates light when, e.g., excitons that are generated by holes injected from the hole injection electrode and electrons injected from the electron injection electrode being combined in the organic emission layer so that the excitons drop to a ground state from an excited state. However, an organic light-emitting display apparatus may deteriorate due to external moisture, oxygen, or the like, and thus, an organic light-emitting device may be sealed in order to protect the organic light-emitting device from external moisture, oxygen, or the like.

Embodiments relate to an organic light-emitting display apparatus that includes a sealing component and a method of manufacturing the same. According to one or more embodiments, a hole may be formed in an encapsulating layer, and an impurity gas included in the encapsulating layer may be discharged via the hole. As such, progressive dark spots that may be generated due to the impurity gas may be removed, and a life-span of an organic light-emitting display apparatus may be increased. Also, the impurity gas may reduce the possibility of and/or prevent another layer disposed below or above the encapsulating layer from being damaged.

While exemplary embodiments has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An organic light-emitting display apparatus, comprising:

a substrate;

a display device on the substrate;

an encapsulating layer that covers the display device, the encapsulating layer including a stacked structure in which a first encapsulating layer and a second encapsulating layer are alternately stacked, the first encapsulating layer including a first hole extending in a direction away from the substrate, and the second encapsulating layer including a second hole extending in the direction away from a substrate; and a getter filling the first hole and the second hole.

2. The organic light-emitting display apparatus of claim 1, wherein the first hole and the second hole are arranged in a thickness direction of the encapsulating layer.

3. The organic light-emitting display apparatus of claim 1, wherein the first hole and the second hole are formed at substantially a same location.

4. The organic light-emitting display apparatus of claim 1, wherein the encapsulating layer is larger than the display device so as to cover the display device, an edge of the encapsulating layer is bound to the substrate, and the first hole and the second hole are in the edge of the encapsulating layer.

5. The organic light-emitting display apparatus of claim 1, wherein the first hole and the second hole are at one or more corners from among a plurality of corners of the encapsulating layer.

6. The organic light-emitting display apparatus of claim 1, wherein the first hole and the second hole extend along at least one side from among a plurality of sides of the encapsulating layer.

7. An organic light-emitting display apparatus, comprising:

a substrate;

a display area on the substrate, the display area including a display device;

a non-display area arranged around the display area on the substrate;

an encapsulating layer on the display area and the non-display area, the encapsulating layer including a stacked structure in which a first encapsulating layer and a second encapsulating layer are alternately stacked, the first encapsulating layer including a first hole extending in a direction away from the substrate, and the second encapsulating layer including a second hole extending in the direction away from a substrate; and a getter in the first hole and the second hole.

8. The organic light-emitting display apparatus of claim 7, wherein one of the first encapsulating layer and the second encapsulating layer includes an inorganic material, and the other of the first encapsulating layer and the second encapsulating layer includes an organic material.

9. The organic light-emitting display apparatus of claim 7, wherein the first hole and the second hole are in the non-display area.

10. A method of manufacturing an organic light-emitting display apparatus, the method comprising:

forming a display area that includes a display device on a substrate;

forming an encapsulating layer on the display area and a non-display area, the non-display area being formed around the display area, the encapsulating layer including a stacked structure in which a first encapsulating layer and a second encapsulating layer are alternately stacked, the first encapsulating layer including a first hole extending in a direction away from the substrate, and the second encapsulating layer including a second hole extending in the direction away from a substrate; and disposing a getter in the first hole and the second hole.

11. The method of claim 10, wherein the forming of the encapsulating layer includes:

forming the first encapsulating layer that includes the first hole;

out-gassing an impurity gas contained in the first encapsulating layer via the first hole;

forming the second encapsulating layer that includes the second hole, the second encapsulating layer being formed on the first encapsulating layer; and out-gassing an impurity gas contained in the second encapsulating layer via the second hole.

12. The method of claim 11, wherein the out-gassing of at least one of the impurity gas contained in the first encapsulating layer and the impurity gas contained in the second encapsulating layer is performed under an inert gas atmosphere.

13. The method of claim 11, wherein the first hole and the second hole are formed in a thickness direction of the encapsulating layer.

14. The method of claim 11, wherein the first hole and the second hole are formed at substantially a same location.

15. The method of claim 10, wherein the first hole and the second hole are formed in the non-display area.

16. The method of claim 10, wherein the first hole and the second hole are formed in a corner of the non-display area.

17. The method of claim 10, wherein the first hole and the second hole are formed along a side of the encapsulating layer.

* * * * *